US005360166A

United States Patent [19]

Nogi et al.

[11] Patent Number: 5,360,166

[45] Date of Patent: Nov. 1, 1994

[54] FUEL INJECTION VALVE

[75] Inventors: Toshiharu Nogi; Minoru Ohsuga; Yoshishige Ohyama, all of Katsuta; Mamoru Fujieda, Tomobe, all of Japan

[73] Assignee: Hitachi, Ltd., Tokyo, Japan

[21] Appl. No.: 854,539

[22] Filed: Mar. 19, 1992

[30] Foreign Application Priority Data

Mar. 20, 1991 [JP] Japan ..... 3-55372

[51] Int. Cl.[5] ..... F02M 61/16

[52] U.S. Cl. ..... 239/404; 239/408; 239/432; 239/585.1; 239/900

[58] Field of Search ..... 239/405, 406, 407, 533.12, 239/585.1, 585.3–585.5, 900, 404, 408, 409, 432

[56] References Cited

U.S. PATENT DOCUMENTS

| | | | |
|---|---|---|---|
| 1,629,288 | 5/1927 | Morse . | |
| 4,235,210 | 11/1980 | Sumiyoshi et al. | 123/471 |
| 4,264,040 | 4/1981 | Saito | 239/900 |
| 4,434,766 | 3/1984 | Matsuoka et al. | 234/405 |
| 4,489,891 | 12/1984 | Momono | 239/406 |
| 4,502,632 | 3/1985 | Hafner et al. | 239/585.3 |
| 4,519,370 | 5/1985 | Iwata | 239/533.12 |
| 4,570,598 | 2/1986 | Samson et al. | 239/585.3 |
| 4,982,716 | 1/1991 | Takeda et al. | 239/533.12 |
| 5,035,358 | 7/1991 | Katsuno et al. | 239/405 |
| 5,058,810 | 10/1991 | Bonfiglioli et al. | 239/533.12 |

FOREIGN PATENT DOCUMENTS

| | | | |
|---|---|---|---|
| 183559 | 11/1982 | Japan . | |
| 24161 | 1/1989 | Japan . | |
| 245470 | 10/1990 | Japan | 239/585.4 |

*Primary Examiner*—Karen B. Merritt

*Attorney, Agent, or Firm*—Antonelli, Terry, Stout & Kraus

[57] ABSTRACT

A fuel injection valve comprising, a fuel swirler (6) providing a swirling force to fuel, a fuel nozzle (5) injecting the swirling fuel, an air swirler (7) including an air swirling chamber (7B) and air nozzles (7A) disposed downstream the fuel nozzle (5) adjacent the outlet port (7C) thereof, the air nozzles (7A) are constituted to introduce air into the air swirling chamber (7B) and to cause a swirling air flow therein directed opposite to the direction of the swirling fuel flow from the fuel nozzle (5) whereby the swirling air flow is caused to collide with the swirling fuel flow immediately after being injected from the fuel nozzle (5) in the air swirling chamber (7B) to thereby enhance atomization of the fuel and to properly decelerate the moving velocity of the injected atomized fuel.

11 Claims, 14 Drawing Sheets

FUEL INJECTION VALVE

BACKGROUND OF THE INVENTION

The present invention relates to a fuel injection valve for an internal combustion engine.

In the field of gasoline engines, such as for automobiles, a system in which a fuel injection valve, such as a solenoid valve, is driven by an electrical signal to inject fuel into a intake passage has been employed.

In connection with these kinds of fuel injection valves, measures for atomizing fuel, such as by swirling the fuel and injecting the same in thin films or by introducing air into a nozzle body of a fuel injection valve and joining the air flow with a swirling fuel after injection, have been proposed as disclosed, for example, in JP-A-57-183559(1982) and JP-A-64-24161(1989).

However, in the conventional art, when atomizing the swirling fuel after injection with the air flow, as indicated above, no special measures were taken to limit the amount of air for atomization introduced into the nozzle body. In particular, such as during an idling operation wherein a small amount of fuel is required, a relatively large amount of air tends to be supplied for the atomization, with the result that the amount of air passing through the throttle valve in the intake air passage when the throttle valve is fully closed has to be extremely limited.

In order to reduce the clearance area of the throttle valve when the same is fully closed, the production accuracy of the throttle valve has to be further enhanced, but this is practically difficult in view of the production cost.

Further, the moving speed of atomized fuel droplets injected from the fuel injection valve is as high as about 20 m/s, so that injected fuel which impacts on an intake pipe wall and/or an intake valve tends to form a liquid film thereon which limits improvement of the fuel atomization.

SUMMARY OF THE INVENTION

One object of the present invention is to provide a fuel injection valve which realizes an efficient fuel atomization with a small amount of air.

Another object of the present invention is to provide a fuel injection valve which realizes an efficient fuel atomization with a small amount of air, while also properly reducing moving speed of the atomized fuel droplets after injection thereof to prevent the fuel from depositing on an intake pipe wall or an intake valve.

A further object of the present invention is to provide a fuel injection valve which realizes an efficient fuel atomization with a small amount of air and is applicable to an internal combustion engine having a plurality of intake valves for for the various cylinders thereof.

For achieving the above objects of the present invention the following measures are taken. The respective measures to be taken are explained hereinbelow by making reference to certain figures of the drawings to be used for explaining embodiments of the present invention for facilitating on understanding thereof.

The first aspect of the present invention, as shown in FIG. 1, is to provide a fuel injection valve having means for injecting fuel via a fuel nozzle 5 while swirling the fuel wherein an air swirling chamber 7B downstream of the fuel nozzle 5 and an air nozzle 7A which introduces air into the air swirling chamber 7B to cause a swirling air flow in a direction opposite to the swirling fuel flow direction are provided. The air swirling chamber 7B is disposed adjacent and near to the outlet of the fuel nozzle 5, so that the swirling fuel flow immediately after being injected from the fuel nozzle 5 will collide with the swirling air flow in the air swirling chamber.

The second aspect of the present invention, as shown in FIG. 15, is to provide a fuel injection valve having means for injecting fuel via a fuel nozzle 5, while swirling the fuel. The fuel is injected a mixing space 2B, in which there is a mixing of the injected fuel with air, the mixing space being disposed downstream of the fuel nozzle 5, which injects fuel while swirling the same, so as to be located adjacent and near to the outlet of the fuel nozzle 5. An annular air nozzle 2A-1 is further disposed facing the mixing space 2B in such a manner as to be concentric with the fuel nozzle 5.

The third aspect of the present invention, as shown in FIG. 19, is to provide a fuel injection valve having means for injecting fuel via a fuel nozzle 5 while swirling the fuel into a mixing space 2B, which causes mixing of the injected fuel with air. The mixing space 2B is disposed downstream of the fuel nozzle 5, which injects the fuel while swirling the same, so as to be located adjacent and near to the outlet of the fuel nozzle 5. Further, a plurality pairs of air nozzles 2A-3 are further disposed so as to face the mixing space 2B with the fuel nozzle 5 being located between the respective pairs of the air nozzles 2A-3 and the air flows injected from the air nozzles 2A-3 forming the respective pairs being directed to the center of the mixing space 2B.

The fourth aspect of the present invention, as shown in FIG. 20, is to provide a fuel injection valve having means for injecting fuel via a fuel nozzle 5 while swirling the fuel, wherein the fuel nozzle 5 which injects the swirling fuel is branched into a plurality of branched fuel nozzles 501 and 5-2, and an air swirling chamber 7B and an air nozzle 7A, which causes a swirling air flow in the air swirling chamber 7B, are disposed downstream of these branched fuel nozzles 5-1 and 502 so as to be located adjacent and near to the outlet of the branched fuel nozzles 5-1 and 5-2. Further, the air swirling chamber 7B is divided for the respective branched fuel nozzles 5-1 and 5-2 and further branched orifices 7E and 7F, which guide the injected fuel toward an intake pipe side, are disposed downstream of the divided air swirling chambers 7B.

The fifth aspect of the present invention, as shown in FIG. 22, is to provide a fuel injection valve having means for injecting fuel via a fuel nozzle 5 while swirling the fuel, wherein the fuel nozzle 5 is branched into a plurality of branched fuel nozzles 5-1 and 5-2, and an air swirling chamber 7B and an air nozzle 7A, which causes a swirling air flow in the swirling chamber 7B are disposed downstream of these branched fuel nozzles 5-1 and 5-2 so as to be located adjacent and near to the outlet of the branched fuel nozzles 5-1 and 5-2. Further, the air swirling chamber 7B is divided for the respective branched fuel nozzles 5-1 and 5-2 by a partition member 40 having sloping surfaces developing in the downstream direction thereof and disposed immediately under the branched fuel nozzles 5-1 and 5-2, so that the fuel passing through the air swirling chamber 7B is caused to collide with the sloping surfaces of the partition member 40.

The sixth aspect of the present invention, as shown in FIG. 25, is to provide a fuel injection valve having means for injecting fuel via a fuel nozzle 5 while swirling the fuel, wherein a fuel branching member 22, which branches the swirling fuel flow immediately after the injection into a plurality of passages, is disposed downstream of the fuel nozzle 5, and an air swirling chamber 7B and an air nozzle 7A, which induces a swirling air flow in the air swirling chamber 7B, are disposed downstream the fuel branching member 22 so as to be located adjacent and near to the fuel branching member 22. Further, the air swirling chamber 7B is divided into a plurality of separate chambers 7B-1 and 7B-2 in correspondence with branched fuel passages 23 provided in the fuel branching member.

The seventh aspect of the present invention, as shown in FIG. 28, is to provide a fuel injection valve having means for injecting fuel via a fuel nozzle 5 while swirling the fuel, wherein the fuel nozzle 5 is branched into a plurality of pairs of branched nozzles 27, and each pair of branched nozzles 27 is designed so that the fuel injected from the respective nozzles of the pair of branched nozzles 27 collides midway after injection therefrom. Further, air swirling chambers 28A and 28B and air nozzles 29, which cause a swirling air flow in the air swirling chambers 28A and 28B, are disposed downstream of the plurality of pairs of the branched fuel nozzles 27 so as to be located adjacent and near to the paired branched fuel nozzles 27.

The eighth aspect of the present invention, as shown in FIG. 30, is to provide a fuel injection valve 1 having a nozzle body 2 with a fuel nozzle 5 disposed in the lower part thereof, wherein the nozzle body 2 is provided with the cylindrical body 34 of having a double wall constructure consisting of an inner cover 34A and an outer cover 34B, both located downstream of the fuel nozzle 5, the inside of the inner cover 34A of the cylindrical body 34 serving as a passage 36 which guides the fuel injected from the fuel nozzle 5. At the outlet of the injected fuel passage 36 is disposed a partition with a pair of sloping surfaces which cause the injected fuel to branch. Further, the annular gap formed between the inner and outer covers 34A and 34B serves as an air passage 35 which is constituted to introduce air from the outside as well as to direct the introduced air to the partition 37 with the pair of the sloping surfaces disposed at the outlet of the injected fuel passage 36 via air nozzles 38 disposed at the outlet side of the inner cover 34A.

According to the first aspect of the present invention, since the air swirling chamber 7B is disposed adjacent and near to the outlet of the fuel nozzle 5, the swirling fuel injected from the fuel nozzle 5 collides with the swirling air flow moving in the opposite direction immediately after the injection, in other words before diffusion thereof. As a result, an efficient declaration as well as atomization of the swirling fuel is achieved with a small amount of air.

As seen from the distribution curve of droplet diameter in the swirling fuel injected from the fuel nozzle 5 as shown in FIG. 16, droplets having larger diameters tend to gather at the outer side from the center of the fuel nozzle 5 due to the inertia thereof and droplets having relatively small diameters tend to gather at the center thereof.

According to the second aspect of the present invention, by properly determining the diameter of the annular air nozzle 2A-1, the swirling air flow can be directed toward the area where the droplets in the swirling fuel having larger diameter gather, with the result that the injected fuel is efficiently atomized with a small amount of air.

According to the third aspect of the present invention, since the air nozzles 2A-3 which face the mixing space 2B are respective directed to the center of the mixing space 2B, the swirling fuel injected from the fuel nozzle 5 is bent toward the center portion by the air flow injected from the air nozzles 2A-3 while being atomized and the fuel not atomized sufficiently tends to collide with other fuel and is atomized as a result of the collision.

The following explanation with regard to the functions and operations of the fuel injection valve according to the present invention principally relates to fuel injection valves suitable for an internal combustion engine having a plurality of intake valves for the various cylinders of the engine.

According to the fourth aspect of the present invention, the swirling fuel is injected toward the respective air swirling chambers 7B via the branched fuel nozzles 5-1 and 5-2 and the injected fuel collides with the swirling air in the respective air swirling chambers 7B so as to be atomized thereby.

A part of the fuel is deposited in the form of a thin film on the wall which faces the orifices 7E and 7F in the course of passing therethrough and the film is atomized by the force of the swirling air flow and injected in the directions determined by the respective orifices 7E and 7F, for example, in case of two intake valves per cylinder, toward the respective intake valves.

According to the fifth aspect of the present invention, the swirling fuel collides with the sloping surfaces of the partition 40 after being injected via the branched fuel nozzles 5-1 and 5-2, while a part thereof is atomized and the remainder thereof is deposited on the partition 40 in the form of a film. On the other hand, in the respective air swirling chambers 7B arranged adjacent to the branched fuel nozzles 5-1 and 5-2, a swirling air flow is generated and the deposited thin film on he partition 40 is blown out while being atomized by the swirling air flow and is injected in predetermined directions via the respective passages 7E and 7F.

According to the sixth aspect of the present invention, the fuel injected from the fuel nozzle 5 collides with the swirling air flow in the respective air swirling chambers 7B-1 and 7B-2 to atomize the same immediately after the fuel is branched by the branching member 22.

According to the seventh aspect of the present invention, the fuel injected from the paired fuel nozzles 27 is provided with a swirling force in the swirling air chambers 28A and 28B immediately after being injected from the fuel nozzles 27 and the fuel is transformed into a thin film by the swirling energy, while being accelerated, and is caused to collide so as to be atomized by the collision energy.

According to the eighth aspect of the present invention, the fuel injected from the fuel nozzle 5 passes through the injected fuel passage 36 in the cylinder body 34 and collides with the sloping surfaces of the partition 37 near the outlet of the cylinder body 34, a part of the fuel is atomized at the partition 37 and is exhausted from the cylinder body 34 while branching and the remainder is deposited on the sloping surfaces of the partition 37. Air is injected on the sloping surfaces of the partition 37 passing via the annular passage 35 and the air nozzles 38, with the result that the deposited thin film is blown out while being atomized and injected in predetermined directions controlled by the partition 37.

According to the first aspect of the present invention, an efficient fuel atomization with a small amount of air is achieved and further, atomized fuel having an injection speed which is effectively reduced is formed which prevents the atomized fuel from depositing on the wall of the intake tube, so that a uniform air and fuel mixture is obtained.

According to the second and third aspects of the present invention, an efficient fuel atomization with a small amount of air is achieved and a uniform air and fuel mixture is obtained.

According to the fourth through eighth aspects of the present invention, which are applicable to an internal combustion engine having a plurality of intake valves for every cylinder, an efficient fuel atomization with a small amount of air is achieved.

DETAILED EXPLANATION OF THE EMBODIMENTS

Figure 1A:
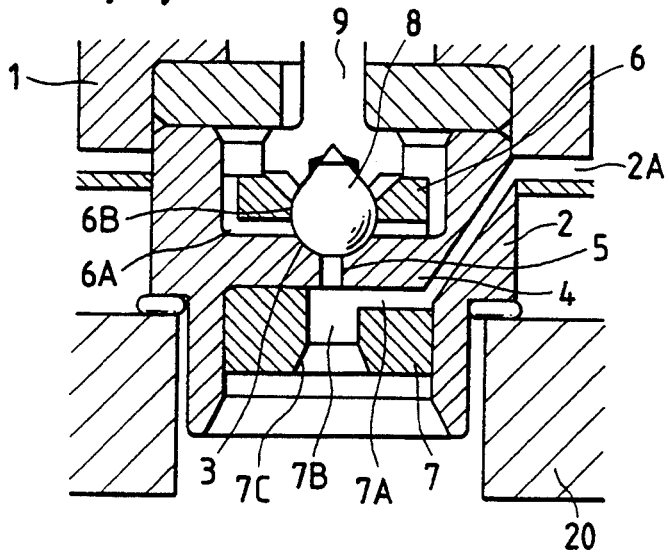
FIG. 1(*a*) and FIG. 1(*b*) show the first embodiment of fuel injection valves according to the present invention wherein FIG. 1(*a*) is a cross section of the major part and FIG. 1(*b*) shows an arrangement of the air swirling chamber and air nozzles in the embodiment.

Hereinbelow, the present invention will be explained with reference to various embodiments shown in the drawings.

Figure 1B:
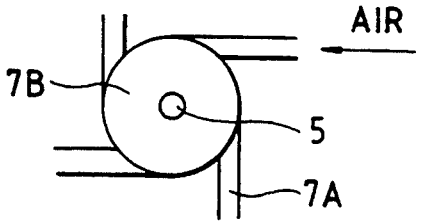
Figure 2:
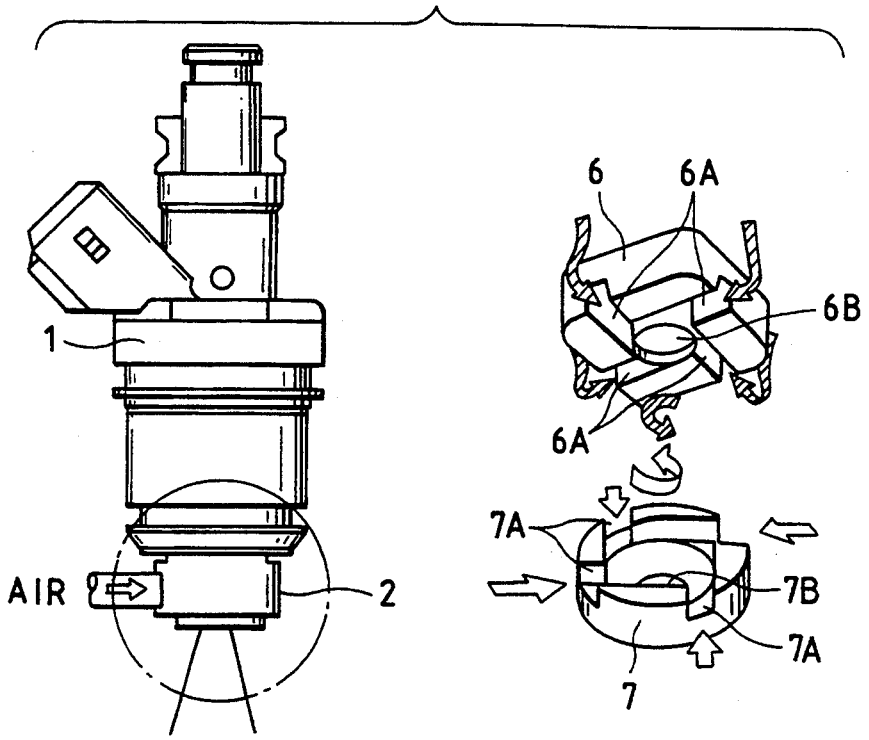
FIG. 2 is a view for explaining the operating principle of the fuel injection valve according to the first embodiment.

FIG. 1(*a*) is a cross section of a major part of the first embodiment according to the present invention, FIG. 1 (*b*) shows an arrangement of the air swirling chamber and air nozzles in the first embodiment and FIG. 2 is a view for explaining the operating principle of the fuel injection valve according to the first embodiment.

In FIG. 2, a solenoid type fuel injection valve 1 incorporates in its main body a solenoid coil and a stationary core, for example, both not shown. A nozzle body 2 is disposed at the bottom portion of the fuel injection valve 1.

Hereinbelow, the internal structure of the nozzle body 2 which is installed at an intake pipe 20 will be explained with reference to FIG. 1.

The nozzle body 2 is formed in a cylindrical shape and includes a raised bottom member 4 having a valve seat 3 disposed inside the nozzle body 2 at substantially the center position thereof. A fuel swirler 6, which provides a swirling force to fuel, is disposed above the nozzle body bottom member 4 and upstream of a metering orifice 5; while, below the nozzle body bottom member 4, downstream of the metering orifice 5, an air swirler 7 is provided with air nozzles 7A and an air swirling chamber 7B.

The fuel swirler 6 is formed from a block-like chip, and four fuel passage grooves 6A, which provide a swirling force to fuel, are formed on the bottom face of the swirler 6. The fuel passage grooves 6A serve as passages for guiding the fuel from the side wall of the chip toward a valve guide hole 6B formed at the center of the chip and are arranged somewhat eccentrically with regard to the center of the valve guide hole 6B. In the present embodiment, the respective fuel passage grooves 6A extend along substantially tangential directions of with respect to the circumference of the valve guide hole 6B. With such a structure, the pressurized fuel which comes out from the fuel passage grooves 6A forms a swirling flow along the wall face of the valve guide hole 6B.

The air swirler 7 is also formed from a block-like chip, and on the upper face thereof four groove-shaped air nozzles 7A, which provide the air with a swirling force, are formed. The air nozzles 7A serve as passages for guiding the air from the side wall of the chip toward the air swirling chamber 7B formed at the center of the chip and are arranged in such a manner that the respective air nozzles 7A extend along substantially tangential directions with respect to the inner circumference of the air swirling chamber 7B. The arrangement of the air nozzles 7A is determined in such a manner that the direction of the swirling air flow is opposite to the direction of the swirling fuel flow.

Figure 5:
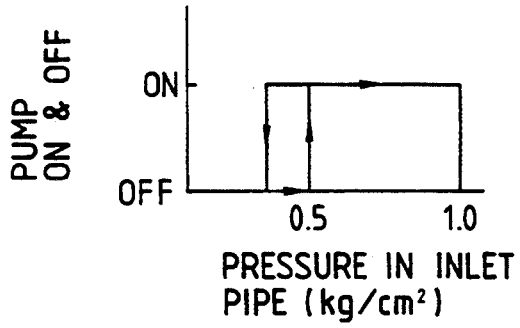
FIG. 5 is a view showing an actuating condition of an air supply pump used for the first embodiment.

As shown in FIG. 1, the air swirling chamber 7B and the air nozzles 7A communicating therewith are disposed adjacent and near to the outlet of the metering orifice of fuel nozzle 5. The air nozzles 7A communicate with respective air passages 2A formed through the side wall of the nozzle body 2. A differential pressure between that in the intake tube 20 and the atmospheric pressure is used as the air pressure source for introducing air to the air passages 2A and the air nozzles 7A; however, when the differential pressure falls below about 0.5 atmospheric pressure, an air pump is used. An operation characteristic of such air pump is shown in FIG. 5 wherein a hysteresis is provided for the air pump operation for preventing a hunting thereof.

A ball valve 8, which performs a valve open and close operation in cooperation with the valve seat 3, is connected to a plunger (not shown) via a rod 9 to which the ball valve 3 is welded, and is moved toward and away from the valve guide hole 6B provided at the fuel swirler 6 via on and off operation of the solenoid coil of the fuel injection valve.

In the present invention, when the ball valve 8 is opened, fuel passes through the fuel passage 6A of the fuel swirler 6 and is provided with a swirling force at the valve guide hole 6B, and thereafter the fuel is injected via the metering orifice 5 into the air swirling chamber 7B in a form of a thin liquid film. On the other hand, the air introduced into the air passage 2A and the air nozzle 7A flows into the air swirling chamber 7B while being provided with a swirling force. Since the directions of the swirling air flow and of the swirling fuel flow are opposite to each other, both swirling flows collide with each other in the air swirling chamber 7B. Accordingly, the swirling fuel flow immediately after being injected from the metering orifice 5 mixes with the air so as to be decelerated in velocity and to promote atomization of the fuel.

The fuel not completely atomized is deposited on the wall of the air swirling chamber 7B; however, the deposited fuel is also separated from the wall by the force of the swirling air flow so as to be formed into a thin film and is injected from the nozzle body 2. Further, the outlet portion 7C of the air swirler 7 is expanded in a taper shape through which the expansion angle of the atomized injection fuel is controlled depending on the size of the intake valve and the distance from the fuel injection valve to the intake valve.

In the present embodiment, the swirling fuel flow joins with the swirling air flow immediately after the fuel is injected from the metering orifice 5. As a result, the swirling fuel flow collides with the swirling air flow moving in the opposite direction in a small swirling space before the swirling fuel flow diffuses, thereby a mixing of the fuel and the air and atomization of the fuel are achieved with an extremely limited amount of swirling air flow, while the velocity of the swirling fuel flow is effectively and properly decelerated.

Figure 3:
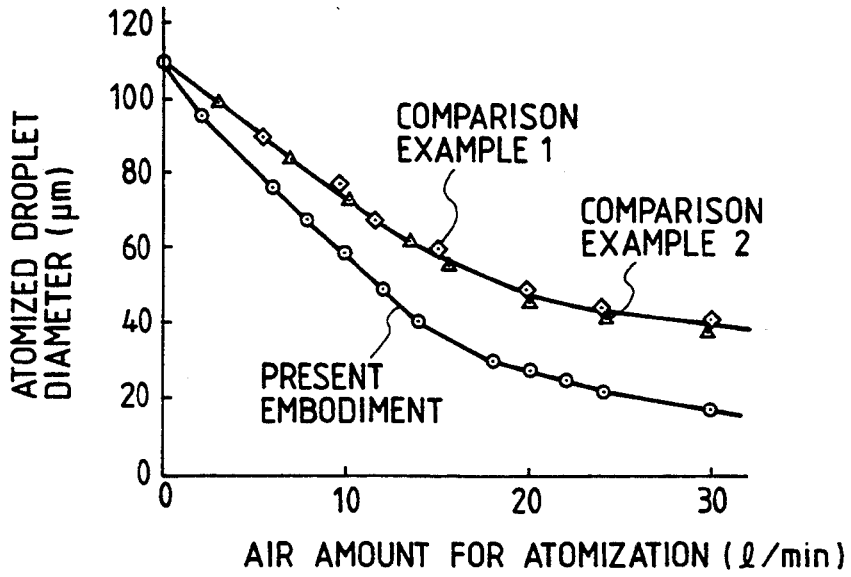
FIG. 3 is a graph showing a relationship between atomized droplet diameter and air amount required for the atomization in connection with the first embodiment and two comparison examples.

FIG. 3 is a diagram of experimental data showing a relationship between air flow rate for fuel atomization and atomized fuel droplet diameter. The curve drawn by plotting the circles represents a relationship obtained when the swirling fuel flow is joined with the swirling air flow moving in the opposite direction in the air swirling chamber 7B immediately after the fuel is injected from the metering orifice 5, such as in the present embodiment. The curve of comparison example 1 drawn by plotting the squares represents a relationship obtained when the swirling fuel flow is joined with an air flow with no air swirling in the same air swirling chamber 7B, and the curve of comparison example 2 drawn by plotting the triangles represents a relationship obtained when the swirling fuel flow injected from the metering orifice 5 is joined with a swirling air flow moving in the opposite direction in the outside of the nozzle body without using the air swirling chamber 7B.

As will be apparent from these curves representing the experimental data, with the fuel injection valve according to the present embodiment, atomization of injected fuel is achieved with a smaller air flow rate for fuel atomization introduced into the fuel injection valve in comparison with the comparison examples 1 and 2.

Figure 4:
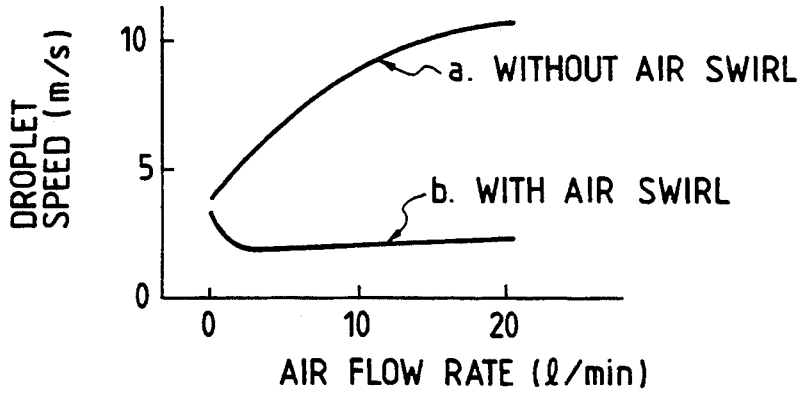
FIG. 4 is a graph showing a relationship between atomized droplet moving speed and air flow rate in connection with the first embodiment and a comparison example.

FIG. 4 is a diagram showing a relationship between air flow rate and atomized droplet moving velocity in a nozzle body. As shown by a curve a, in a case of a nozzle body without air swirling, when the air flow rate around the injected fuel is increased, the moving velocity of the atomized injection fuel is increased. However, when a swirling air flow moving in an opposite direction is applied to the swirling fuel flow as shown by curve b in FIG. 4, the moving velocity of the atomized injection fuel in the injection direction is reduced. Thereby, the injected fuel is easily carried by the air flow in the intake tube and the deposition of the fuel on the walls of the intake tube and of the intake valve is effectively prevented.

Figure 6:
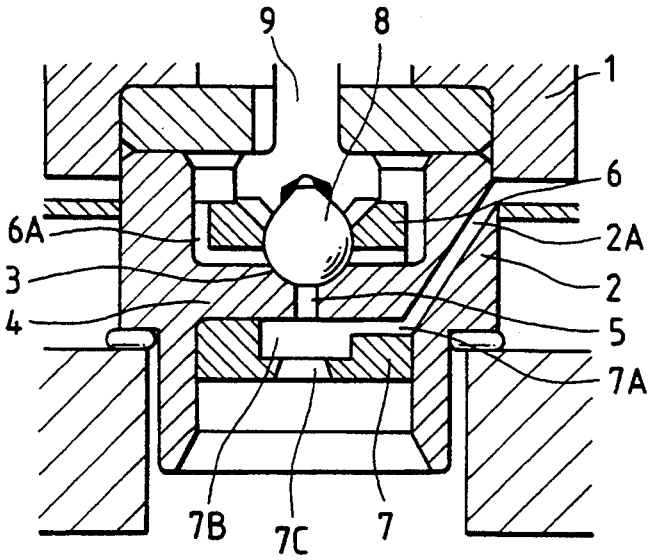
FIG. 6 is a cross section of a major part of the second embodiment of fuel injection valves according to the present invention.

FIG. 6 is a cross section of a major part showing the second embodiment of the present invention. In the drawing the elements bearing the same reference numerals as in the first embodiment are the same or equivalent elements as those in the first embodiment, which is also true with respect to the other embodiments shown in FIG. 7 and those described thereafter.

The basic structure of the present embodiment is substantially the same as that of the first embodiment except that, although the air swirler 7 is preferably disposed adjacent the outlet of the metering orifice 5, the flow passage area of a tapered outlet portion 7C formed downstream of the air swirling chamber 7B in the air swirler 7 is formed to the narrower than that of the air swirling chamber 7B. With the present embodiment thus constructed, in addition to the advantages obtained by the first embodiment, the degree of the fuel atomization and air/fuel mixing rate are further enhanced because the air and fuel are mixed in such a narrow region 7C.

Figure 7:
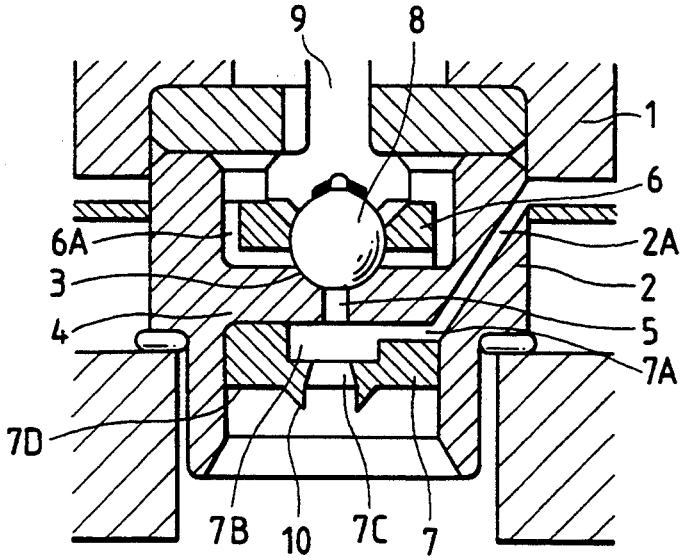
FIG. 7 is a cross section of a major part of the third embodiment of fuel injection valves according to the present invention.

FIG. 7 is a cross section of a major part showing the third embodiment of the present invention.

The basic structure of the present embodiment is substantially the same as those of the preceeding embodiments except that a projecting portion 10 is provided around the circumference of the outlet portion 7C of the air swirler 7. When no such projecting portion 10 is provided and when the air flow rate is low, the fuel which comes out from the air swirler 7 tends to form large size droplets by turning round toward the bottom face 7D of the air swirler 7; however, with the provision of the projecting portion 10 at the outlet portion 7C, the fuel is deposited on the projecting portion 10 in a form of thin film to prevent the same from turning around toward the bottom face 7D. As a result, the deposited fuel on the projecting portion 10 is continuously blown off in a form of thin film before growing into a large sized fuel drop, thereby a further fuel atomization is achieved.

Figure 8:
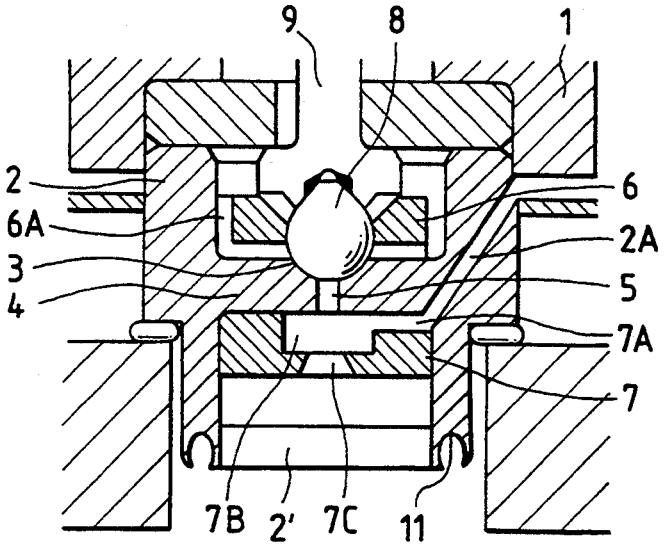
FIG. 8 is a cross section of a major part of the fourth embodiment of fuel injection valves according to the present invention.

FIG. 8 is a cross section of a major part showing the fourth embodiment of the present invention. The basic structure of the present invention is substantially the same as the second embodiment shown in FIG. 6 except that a groove 11 is additionally formed around the circumference of an outlet guide portion 2 in the nozzle body 2. Thereby, even when the air flow rate is low, the fuel which flows around toward the guide portion 2 is caught by the groove 11 to limit injection of large sized fuel drops. Moreover, when the air flow rate is increased, the fuel caught in the groove 11 is sucked out to atomize the same.

Figure 9:
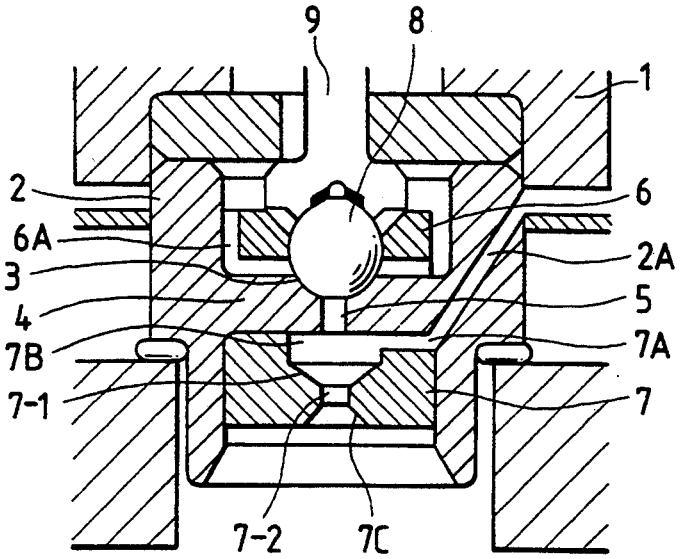
FIG. 9 is a cross section of a major part of the fifth embodiment of fuel injection valves according to the present invention.

FIG. 9 is a cross section of a major part showing the fifth embodiment of the present invention. The basic structure of the present embodiment is also substantially the same as that of the previous embodiments except that the flow passage area of a lower end portion 7-1 of the air swirling chamber 7B in the air swirler 7 is formed by restricting the flow passage area in a taper shape and a nozzle body small hole 7-2 continues from the lower end portion 7-1 and thereafter an outlet portion 7C extending the flow passage area in a taper shape is connected to the nozzle body small hole 7-2. According to the fifth embodiment thus constituted, the mixture of air and fuel, after the swirling flows of air and fuel having joined in the air swirling chamber 7B, is conveyed to the small hole 702 so as not to cause a loss in kinetic energy thereof. Further, through the outlet portion 7C, which is expanded in a taper shape of the air swirler 7, the angle of injection of the atomized fuel is controlled, in that when the taper angle of 25° is selected, the expanded angle of atomized injection fuel is also controlled about at 25°.

Figure 10:
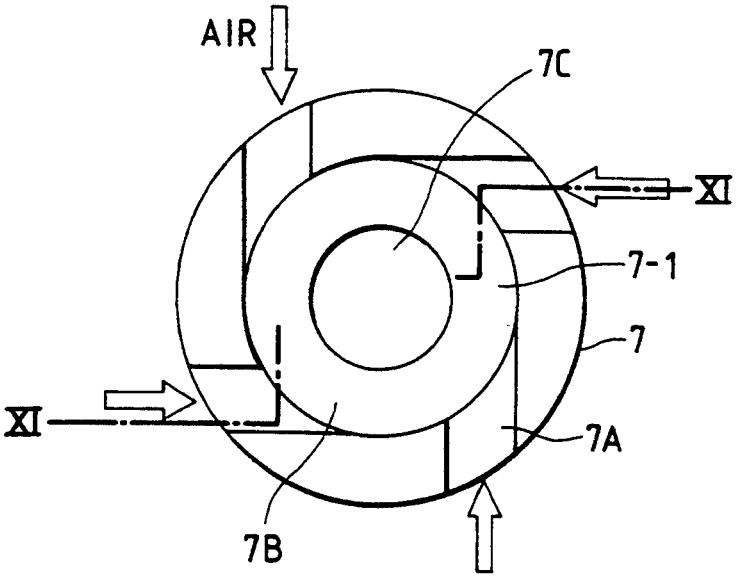
FIG. 10 is a plane view showing an air swirler used in the sixth embodiment of fuel injection valves according to the present invention.
Figure 11:
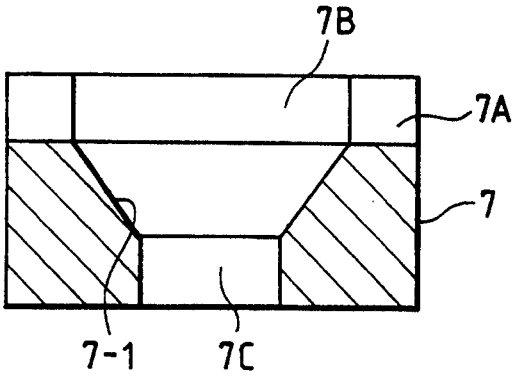
FIG. 11 is a cross section taken along the line XI—XI in FIG. 10.

FIG. 10 shows a plane view of the swirler 7 used for the sixth embodiment of the present invention and FIG. 11 shows the cross section taken along the line XI—XI in FIG. 10.

In the present embodiment, although only an air swirler 7 is taken out and illustrated, the structure and arrangement of the other elements of the fuel injection valve are substantially the same as the previous embodiments. In the air swirler 7 of the present embodiment, a lower end portion 7-1 of an air swirling chamber 7B is formed by restricting the flow passage area in a taper shape like the fifth embodiment; however, unlike the fifth embodiment, the tapered lower end portion is directly connected to an orifice shaped air outlet portion 7C.

By constructing the air flow passage in this way, the air flow passage area at the air outlet portion 7C is the narrowest among the air flow passage areas of the air swirler 7, in that the air flow passage area of the air outlet portion 7C is narrower than the total of the four air nozzles 7A, such that the air flow rate introduced into the air swirler 7 is determined by the air flow passage area of the air outlet portion 7C. Further, by restricting the air flow passage area from the lower end portion 7-1 to the air outlet portion 7C, the velocity of the swirling air flow is increased to increase the collision force with the swirling fuel flow moving in an opposite direction, thereby the deceleration of the fuel injection speed and atomization are further enhanced.

Figure 12:
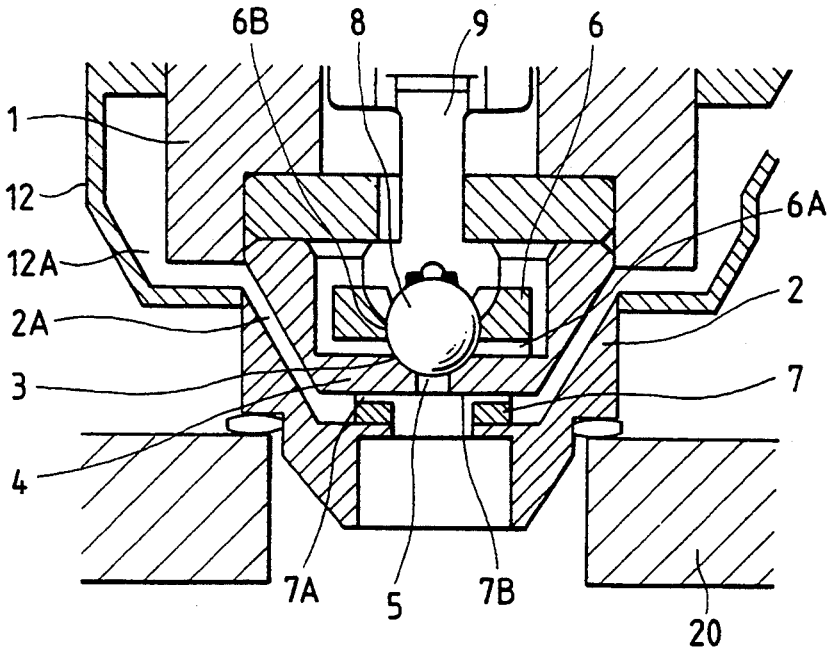
FIG. 12 is a cross section of a major part of the seventh embodiment of fuel injection valves according to the present invention.

FIG. 12 is a cross section of a major part showing the seventh embodiment of the present invention.

The basic structure of the present embodiment is also substantially the same as the previous embodiments except that a cylindrical cover member 12 is disposed around the lower portion of the main body of the fuel injection valve 1 so as to form an air passage 12A therebetween which communicates to the air passages 2A of the nozzle body 2 and the air nozzles 7A of the air swirler 7.

Figure 13:
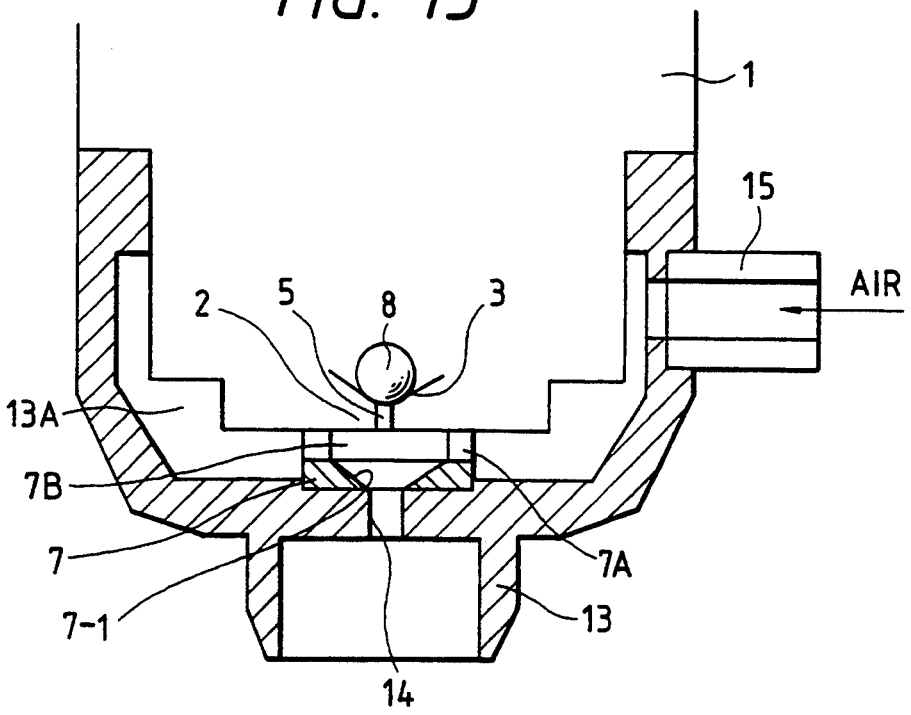
FIG. 13 is a cross section of a major part of the eighth embodiment of fuel injection valves according to the present invention.

FIG. 13 is a schematic cross section of the eighth embodiment of the present invention.

In the present embodiment, a nozzle body 2 having a metering orifice 5 is disposed at the lower portion of the fuel injection valve and an air swirler 7 is disposed below the nozzle body 2 so as to contact the metering orifice 5. A cover 13 which covers the lower portion of the main body of the fuel injection valve 1 is disposed below the air swirler 7. The cower 13 is provided with an injection port 14, which injects the mixture of air and fuel, and an air inlet port 15.

The air swirler 7 is assembled by being sandwiched between the nozzle body 2 and the cover 13 and the air flow passage area in the air swirling chamber 7B of the air swirler 7 is restricted in a taper shape at the lower end portion 7-1 thereof. The tapered air swirling restricted lower portion 7-1 is assembled so as to communicate with an injection port 14 formed in the cover 13. Between the cover 13 and the main body of the fuel injection valve 1 an air passage 13A is formed which communicates with the air nozzles 7A. Although now shown in the drawing, the fuel swirler is of course disposed upstream the metering orifice 5 in the present embodiment.

In the present embodiment, the cover 13 can be secured to the main body of the fuel injection valve with a simple measure, such as press fitting, to form the air passages 13A communicating with the air swirler 7, and further in combination of the injection port 14 provided at the cover side and the air swirler 7, substantially the same type of air swirling as that of the sixth embodiment shown in FIG. 11 is obtained. The structure itself of the air swirler 7 of the present embodiment is more simplified than that of the sixth embodiment.

Figure 14:
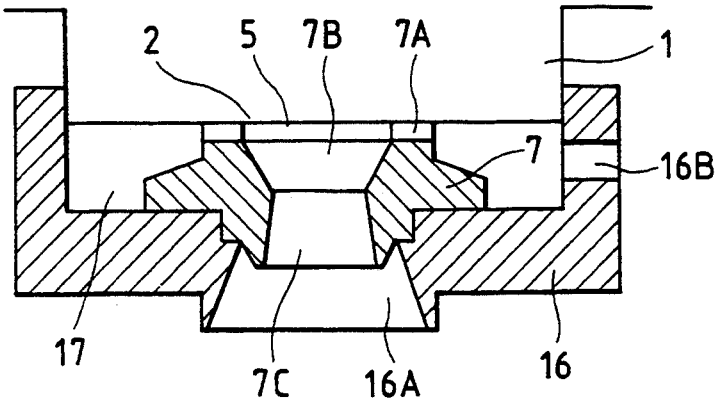
FIG. 14 is a cross section of a major part of the ninth embodiment of fuel injection valves according to the present invention.

FIG. 14 is a cross section of a major part showing the ninth embodiment of the present invention.

In the present embodiment, like the cover 13 in the eighth embodiment, a cover 16 is secured at the lower portion of the fuel injection valve. The cover 16 is provided with a taper shaped outlet port 16A which guides the mixture of air and fuel joined in the air swirler 7, and an air inlet port 16B.

The air swirler 7 is disposed so as to be closed to the outlet port of the metering orifice 5 and is sandwiched between the nozzle body 2 provided below the main body of the fuel injection valve and the cover 16.

Between the cover 16 and the main body of the fuel injection valve 1, an air passage 17 communicating with the air nozzles 7A in the air swirler 7 is provided.

Figure 15A:
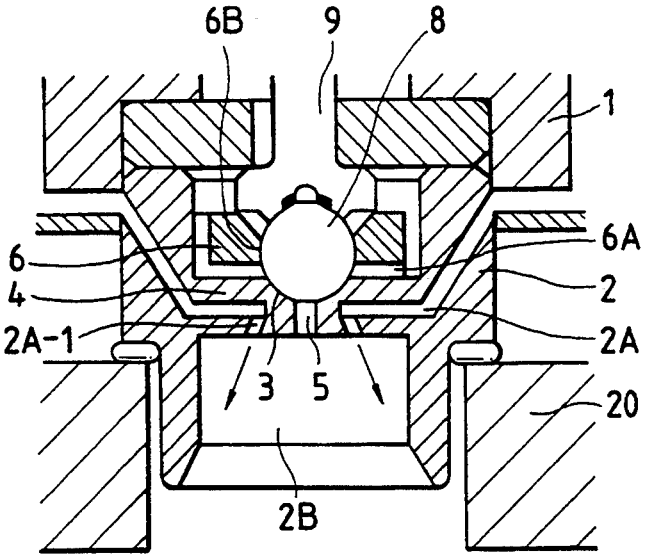
FIG. 15(*a*) is a cross section of a major part of the tenth embodiment of fuel injection valves according to the present invention, and FIG. 15(*b*) is the bottom view thereof.
Figure 15B:
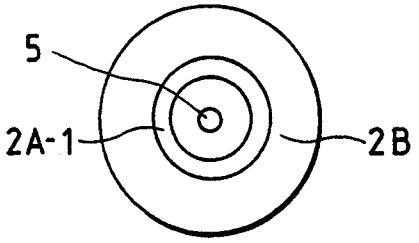

FIG. 15(*a*) is a cross section of a major part of the tenth embodiment of the present invention and FIG. 15(*b*) is a view of a part of the nozzle body in FIG. 15(*a*) looking from the bottom thereof.

In the present embodiment, the fuel swirler 6 is preferably disposed upstream of the metering orifice 5 in the nozzle body 2; however, as opposed to the previous embodiments, the air swirler is not provided below the metering orifice 5, but a space or a mixing chamber 2B for mixing the injected fuel and air is provided downstream of the metering orifice 5.

Air passages 2A which introduce air from outside to the mixing chamber 2B and cause air flow therein are formed in the bottom portion 4 of the nozzle body 2 and the outlet; in other words, the air nozzle 2A-1 of the air passage is formed in an annular shape and is directed outwardly toward the outlet port.

The annular air outlet port 2A-1 is arranged in the nozzle body bottom portion 4 so as to face the mixing chamber 2B in a concentric manner with the metering orifice 5 as shown in FIG. 15(*b*).

In the present embodiment, the swirling fuel from the metering orifice 5 is injected into the mixing chamber 2B, and the air injected into the mixing chamber 2B via the air passage 2A and the annular air nozzle 2A-1 forms an air flow expanding in a conical shape as shown by the arrows.

Figure 16:
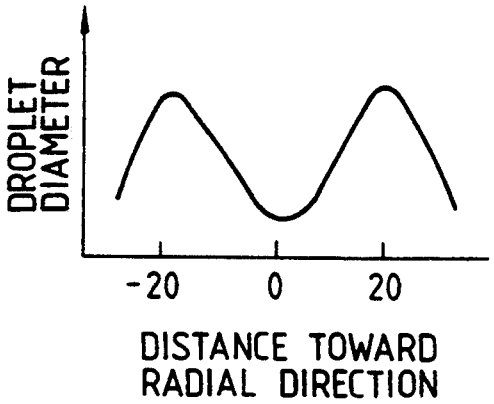
FIG. 16 is a diagram for explaining a droplet diameter distribution in a swirling fuel injected from a fuel injection valve.

FIG. 16 shows a distribution of injected atomized fuel droplet diameter in a hollow conical swirling fuel flow when no air is introduced into the mixing chamber 2B. As seen from the distribution, fuel droplets having larger diameters tend to gather in outside areas spaced from the center. This is because the larger the fuel droplet diameter is the higher is the inertia thereof.

For such fuel injection valves having the above explained fuel droplet diameter distribution, when the annular air nozzle 2A-1 is provided and the diameter of the outlet port of the annular air nozzle 2A-1 is selected so that the conical shaped air flow injected from the annular air nozzle 2A-1 is directed to the region where the fuel droplets having the largest diameter gather, the air flow concentrately collides with the fuel droplets having larger diameters such that the atomization of the entire injected fuel is effectively achieved with a small amount of air.

Figure 17A:
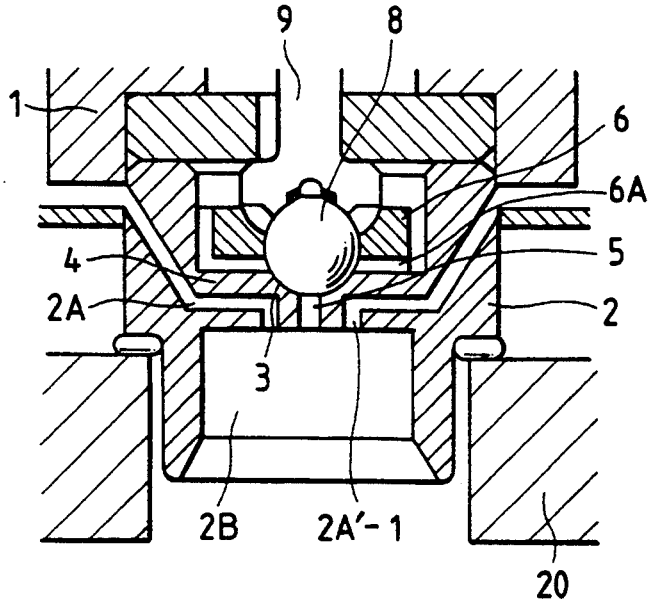
FIG. 17(*a*) is a cross section of a major part of the eleventh embodiment of fuel injection valves according to the present invention, and FIG. 17(*b*) is the bottom view thereof.
Figure 17B:
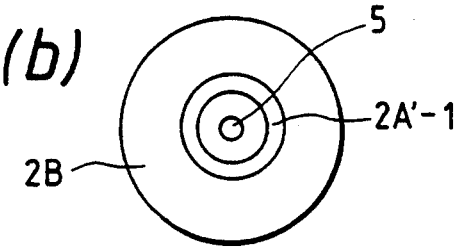

FIG. 17(*a*) is a cross section of a major part of the eleventh embodiment of the present invention and FIG. 17(*b*) is a view of a part of the nozzle body in FIG. 17(*a*) looking from the bottom thereof.

In the present embodiment, like the tenth embodiment shown in FIG. 15(*a*) and FIG. 15(*b*), an annular air nozzle 2A'-1 formed in the nozzle body bottom portion 4 is disposed close to the metering orifice 5 so as to be concentric therewith, however the outlet port of the air nozzle is configured to generate a cylindrical shaped air flow. Since the injected air flow velocity immediately after the injection from the air nozzle outlet port 2A'-1 is large and the injected air flow having a larger velocity is adapted to collide with the injected fuel in the present embodiment, an effective atomization of the injected fuel is achieved.

Figure 18A:
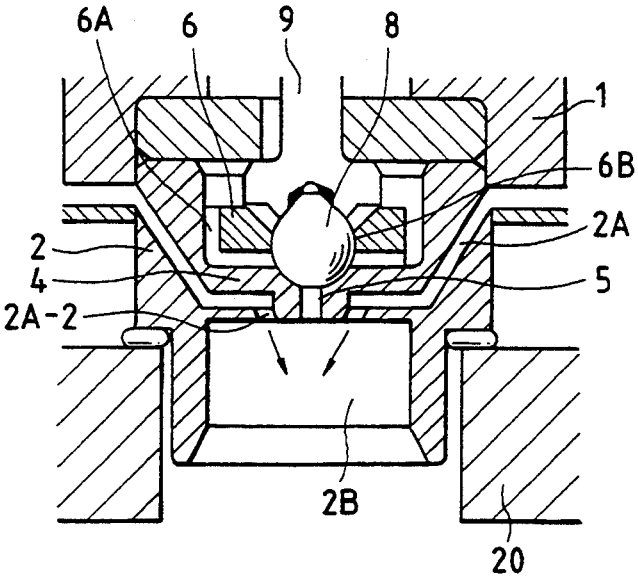
FIG. 18(*a*) is a cross section of a major part of the twelveth embodiment of fuel injection valves according to the present invention, and FIG. 18(*b*) is the bottom view thereof.
Figure 18B:
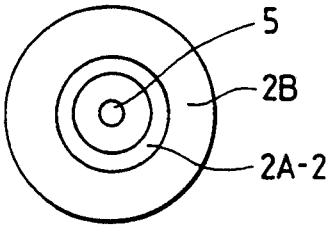

FIG. 18(*a*) is a cross section of a major part of the twelveth embodiment of the present invention and FIG. 15(*b*) is a view of a part of the nozzle body in FIG. 18(*a*) looking from the bottom thereof.

In the present embodiment, like the tenth and eleventh embodiments shown in FIG. 15(*a*) and FIG. 15(*b*), FIG. 17(*a*) and FIG. 17(*b*), an annular air nozzle 2A-2 is disposed near the metering orifice 5 so as to be concentric therewith; however, the outlet port of the annular air nozzle 2A-2 is formed so as to be directed toward the center line of the metering orifice 5. With the present embodiment, the expanding angle of the entire injected atomized fuel is restricted.

Figure 19A:
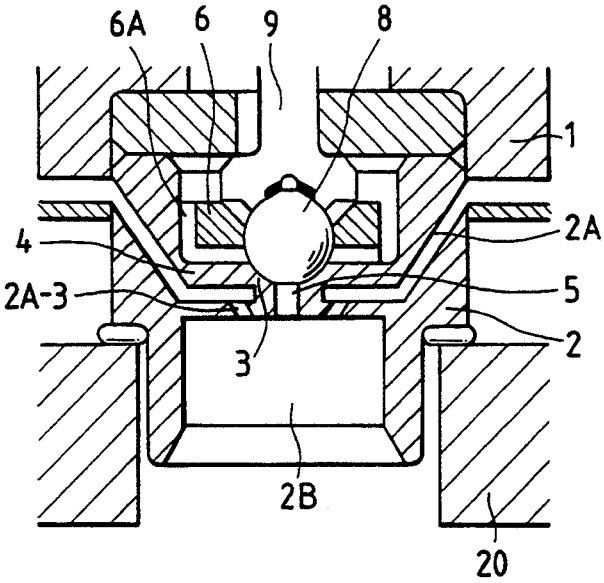
FIG. 19(*a*) is a cross section of a major part of the thirteenth embodiment of fuel injection valves according to the present invention, and FIG. 19(*b*) is the bottom view thereof.
Figure 19B:
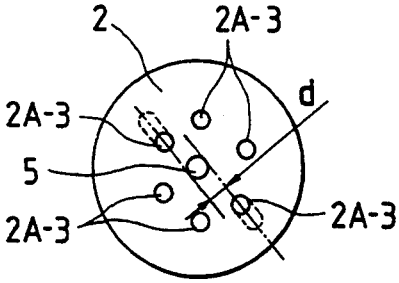

FIG. 19(*a*) is a cross section of a major part of the thirteenth embodiment of the present invention and FIG. 19(*b*) is a view of a part of the nozzle body in FIG. 19(*b*) looking from the bottom thereof.

In the present embodiment, a plurality of pairs of air nozzles 2A-3 are provided at the bottom portion 4 of the nozzle body 2.

The respective air nozzles 2A-3 are directed toward the center line of the metering orifice 5 and each pair of the air nozzles 2A-3 are disposed at an equal distance from the metering orifice, in other words, from the fuel nozzle, while being centered with respect to the metering orifice 5 and opposing each other.

By this arrangement, the fuel injected from the metering orifice 5 is atomized while being forced toward the center and the fuel not completely atomized is caused to collide with other fuel so as to atomize the same. Our experiment showed that when an offset d between a pair of air nozzles 2A-3 is determined to be about a half of the diameter of the metering orifice 5, although the drawings do not necessarily illustrate the above clearly, recombination of the atomized fuel droplets at the injection center is prevented and atomized fuel droplets having a minimum diameter are obtained.

Figure 20:
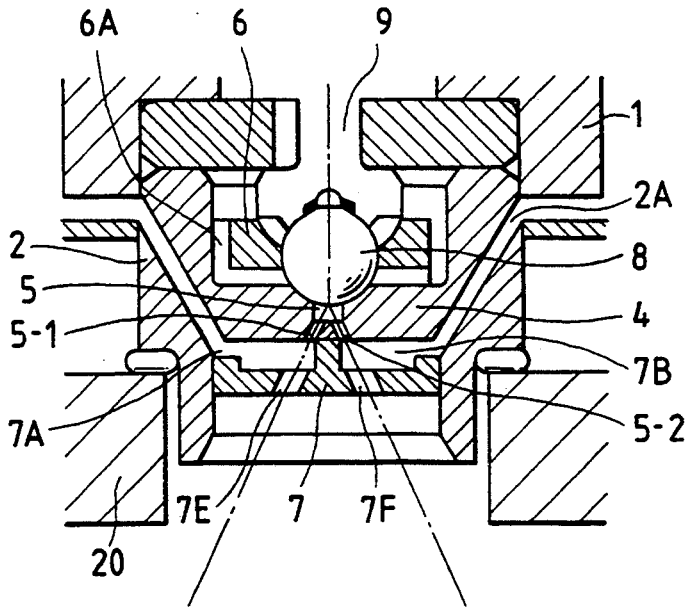
FIG. 20 is a cross section of a major part of the fourteenth embodiment of fuel injection valves according to the present invention.

FIG. 20 is a cross section of a major part of the fourteenth embodiment according to the present invention.

The present embodiment is applicable to an internal combustion engine having two intake valves for every cylinder. In the present embodiment, a metering orifice 5 is disposed downstream of the ball valve 8 and further downstream of the metering orifice 5 two branched fuel nozzles 5-1 and 5-2 are disposed. Further, downstream of the fuel nozzles 5-1 and 5-2, an air swirler 7 is provided with air nozzles 7A and air swirling chambers 7B.

Two air swirling chambers 7B are formed corresponding to the respective fuel nozzles 5-1 and 5-2 and orifices 7E and 7F forming outlets for the respective air swirling chambers 7B are formed in the air swirler 7. The orifice 7E is arranged on the extension line of the fuel nozzle 5-1 with the same expanding angle as that of the fuel nozzle 5-1 and the same relationship is applied to that between the orifice 7F and the fuel nozzle 5-2.

In the present embodiment, the fuel injected from the fuel nozzles 5-1 and 5-2 into the respective air swirling chambers 7B is caused to collide with the swirling air flow immediately after being injected from the fuel nozzles 5-1 and 5-2 to atomize the same. The atomized fuel generated by the collision with the swirling air is divided into two flow directions by the orifices 7E and 7F and is directed toward respective intake valves of a predetermined cylinder.

Figure 21:
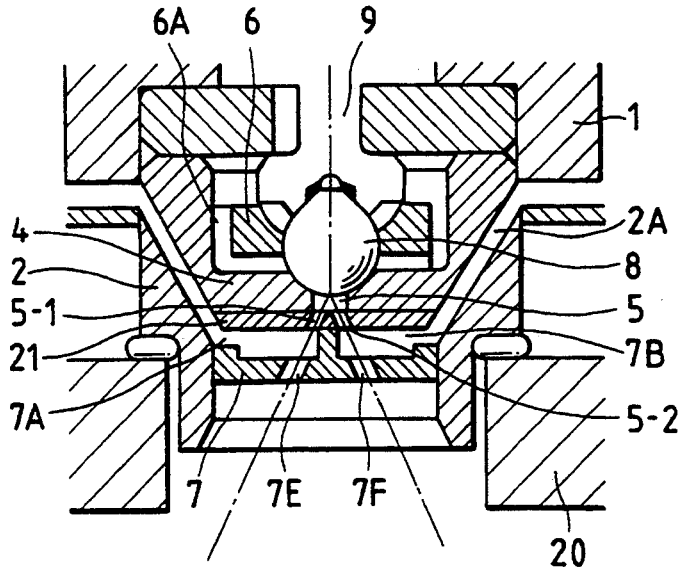
FIG. 21 is a cross section of a major part of the fifteenth embodiment of fuel injection valves according to the present invention.

FIG. 21 is a cross section of a major part of the fifteenth embodiment according to the present invention.

The basic structure of the present embodiment is substantially the same as the fourteenth embodiment shown in FIG. 20 except that the fuel nozzles 5-1 and 5-2 are formed in a separate thin plate 21, having a thickness below 0.2 mm, as compared to the nozzle body 2, such that the structure of the nozzle body is simplified and the formation thereof is also facilitated.

Figure 22:
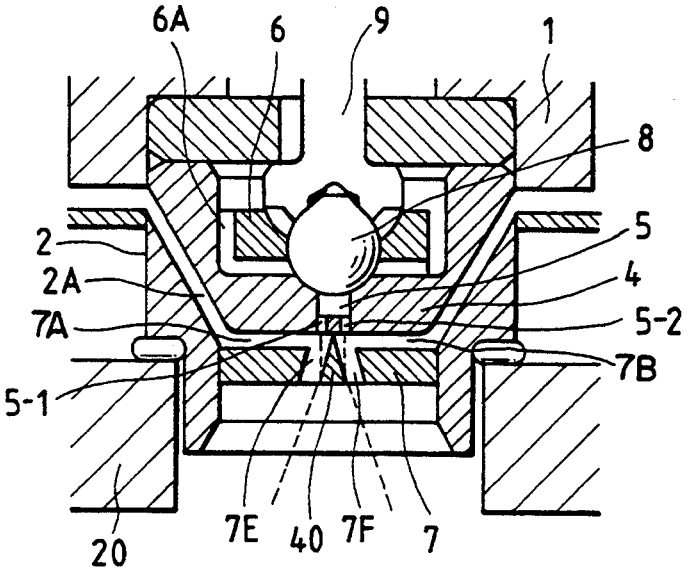
FIG. 22 is a cross section of a major part of the sixteenth embodiment of fuel injection valves according to the present invention.

FIG. 22 is a cross section of a major part of the sixteenth embodiment of the present invention.

In the present embodiment, the fuel nozzle 5 is branched at the intermediate portion thereof into two fuel nozzles 5-1 and 5-2 which extend in parallel to the axis of the fuel nozzle 5, a thin layered air swirling chamber 7B is disposed adjacent to the fuel nozzles 5-1 and 5-2, and, downstream of the air swirling chamber 7B, orifices 7E and 7F are disposed. The respective orifices 7E and 7F are defined by a partition 40 with sloping surfaces of triangular cross section.

The air flowing into the air swirling chamber 7B via an air passage 2A collides with the fuel injected from the respective fuel nozzles 5-1 and 5-2 in the form of a thin film to atomize the same. The part of the injected fuel which is deposited on the sloping surfaces of the partition 40 in the form of thin film is blown off by the swirling air flow to atomize the same. Via the above processes atomized fuel droplets are formed and injected in predetermined directions controlled by the respective orifices 7E and 7F.

Figure 23A:
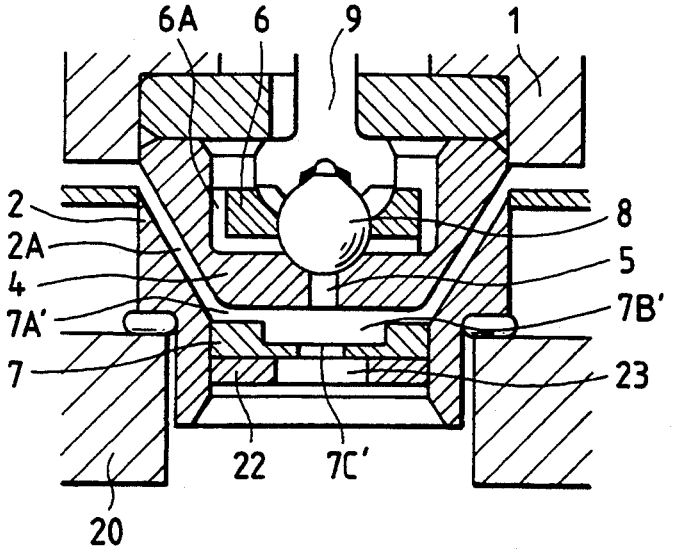
FIG. 23(*a*) is a cross section of a major part of the seventeenth embodiment of fuel injection valves according to the present invention and FIG. 23(*b*) is the bottom view thereof.
Figure 23B:
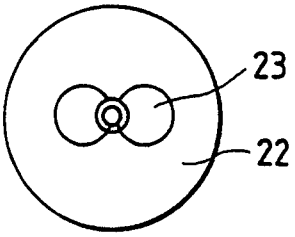

FIG. 23(*a*) is a cross section of a major part of the seventeenth embodiment of the present invention and FIG. 23 (b) is a view of a part of the nozzle body in FIG. 23(*a*) looking from the bottom thereof.

In the present embodiment, downstream of the fuel nozzle 5, which injects the swirling fuel, an air swirling chamber 7B' is preferably formed adjacent to the outlet port of the fuel nozzle 5; however, the air swirling chamber 7B' is provided with air nozzles 7A' which cause swirling air flowing in the same direction as the swirling fuel flow.

Further, immediately downstream of the air swirling chamber 7B' a plate 22 having an hour glass shaped hole 23 is disposed.

According to the present embodiment, which is applicable to an internal combustion engine having two intake valves for every cylinder, for instance, when a differential pressure between that in the intake tube 20 and the atmospheric pressure is small and air via the air passage is hardly introduced into the air swirling chamber 7B', the fuel expands in two directions defined by the hour glass shaped hole 23 by its own swirling force to form atomized fuel directed in two directions. When air is introduced, the swirling fuel is further accelerated by the swirling air flow to thereby form a thin liquid film and to reduce the diameter of the atomized droplets, and the atomized fuel droplets are expanded by the swirling air force in two directions by the hour glass shaped hole 23.

Figure 24:
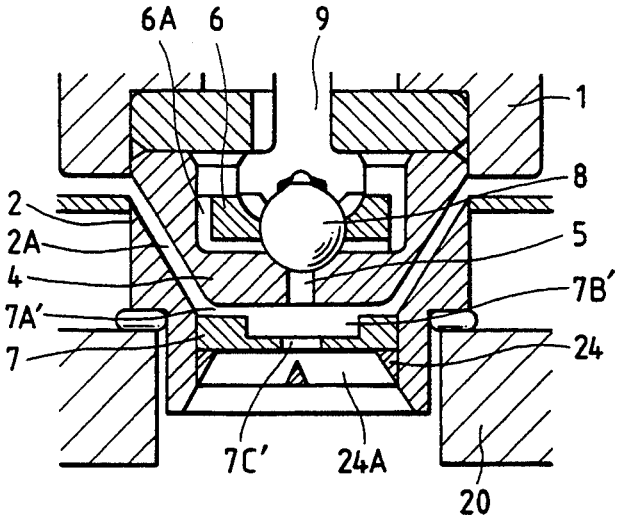
FIG. 24(*a*) is a cross section of a major part of the eighteenth embodiment of fuel injection valves according to the present invention and FIG. 24(*b*) is the bottom view thereof.
Figure 24:
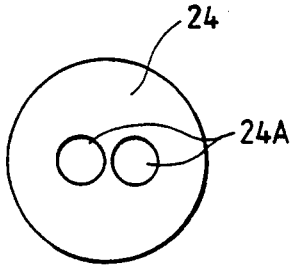

FIG. 24(*a*) is a cross section of a major part of the eighteenth embodiment of the present invention and FIG. 24(*b*) is a view of a part of the nozzle body in FIG. 24(*a*) looking from the bottom thereof.

In the present embodiment, like the seventeenth embodiment as shown in FIG. 23(*a*) and FIG. 23(*b*), a plate 24 having a pair of holes 24A used for branching the atomized fuel is disposed adjacent to the outlet portion 7C' of the air swirling chamber 7B'. The fuel atomized in the air swirling chamber 7B' is branched in two directions by the pair of holes 24A and the directions of the atomized fuel coincide with the branching directions by the pair of holes 24A.

Figure 25:
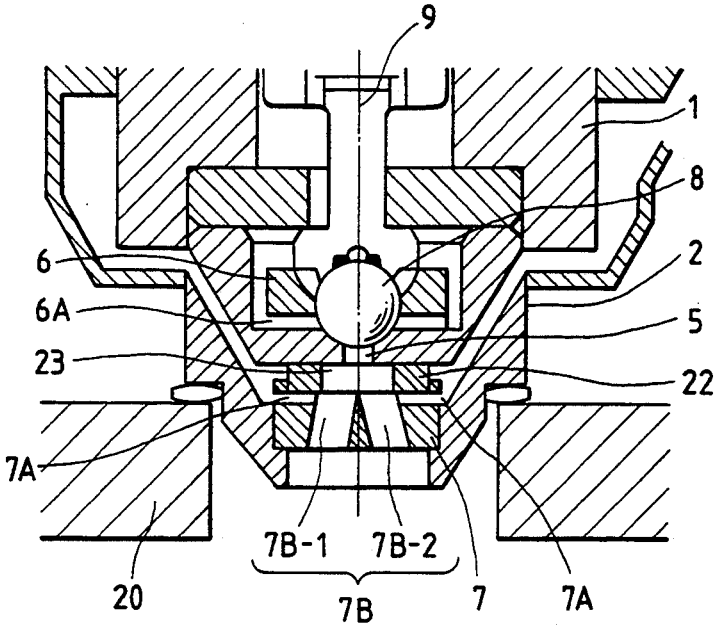
FIG. 25 is a cross section of a major part of the nineteenth embodiment of fuel injection valves according to the present invention.
Figure 26:
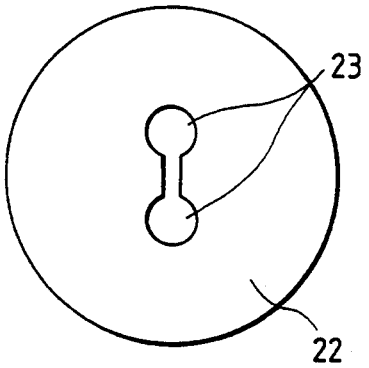
FIG. 26 is a plane view of a fuel branching member used in the nineteenth embodiment shown in FIG. 25.
Figure 27:
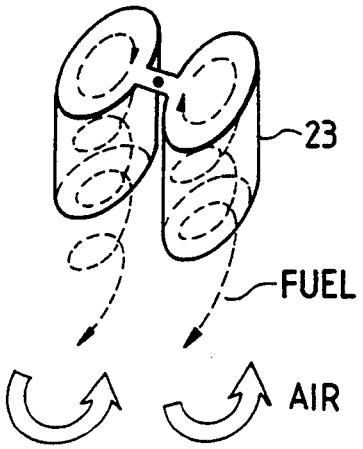
FIG. 27 is a view for explaining the operation of the nineteenth embodiment shown in FIG. 25 and FIG. 26.

FIG. 25 is a cross section of a major part of the nineteenth embodiment of the present invention, FIG. 26 is a plane view of a fuel branching plate used for the nineteenth embodiment shown in FIG. 25, and FIG. 27 shows a behavior diagram of the fuel passing through the fuel branching plate in connection with that of the air.

In the present embodiment, which is different from the previous embodiments, a plate 22 for branching fuel is disposed downstream of the fuel nozzle which injects a swirling fuel. Further, downstream of the fuel branching plate 22, an air swirling chamber 7B is formed.

The fuel branching plate 22 is provided with dumb bell shaped hole 23 as shown in FIG. 26, and FIG. 27 which may be replaced by the separate two holes 24A shown in FIG. 24 (*b*), and below the fuel branching plate 22, an air swirling chamber 7B branched into two chambers 7B-1 and 7B-2 is disposed. In these air swirling chambers 7B-1 and 7B-2 air nozzles 7A are arranged so as to generate a swirling air flow in a direction opposite to the swirling fuel flow injected from the fuel nozzle 5. Further these air nozzles 7A and air swirling chambers 7B-1 and 7B-2 are formed in a chip shaped main body of the air swirler 7.

According to the present embodiment, the swirling fuel injected from the fuel nozzle 5 is for the first time divided into two parts by the dumb bell shaped hole 23, as shown in FIG. 27, and thereafter the respective parts of the swirling fuel collide with the swirling air flow moving in opposite direction in the course of passing through the respective air swirling chambers 7B-1 and 7B-2 to promote atomization of the fuel.

Figure 28A:
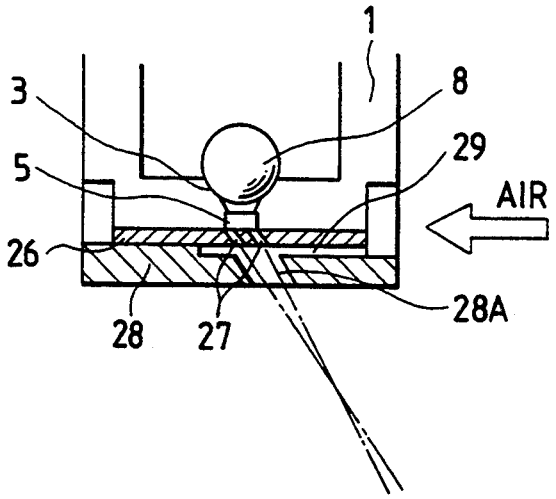
FIG. 28(*a*) is a cross section of a major part of the twentieth embodiment of fuel injection valves according to the present invention and FIG. 28(*b*) is the bottom view thereof.
Figure 28B:
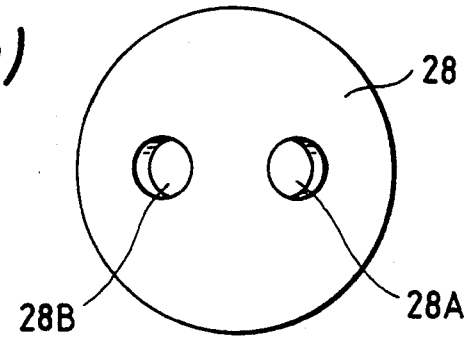

FIG. 28(*a*) is a cross section of a major part of the twentieth embodiment of the present invention and FIG. 28(*b*) is a view of a part of the nozzle body in FIG. 28(*b*) looking from the bottom thereof.

In the present embodiment, no fuel swirler is provided. Instead, an orifice plate 26 having a plurality pair of orifices 27 constituting fuel nozzles is disposed downstream of the orifice 5 forming a fuel passage, and the directions of the paired orifices 27 are selected in such a manner that the fuel particles injected therefrom collide with each other. Downstream of the respective pairs of orifices, orifices 28A and 28B for swirling air are disposed.

To the respective air swirling orifices 28A and 28B, air is introduced from the outside of the fuel injection valve 1 via an air passage 29 to generate a swirling air flow.

The fuel is injected into the respective air swirling orifices 28A and 28B from the respective paired fuel nozzles 27, the fuel immediately after the injection is acted on by the swirling force due to the swirling air flow and is rendered into thin films, and thereafter the fuel particles are caused to collide with each other to enhance the thin filming and a part of the fuel is atomized. Further, thereafter the thin filming of the fuel is advanced by the swirling air to atomize the same.

Figure 29A:
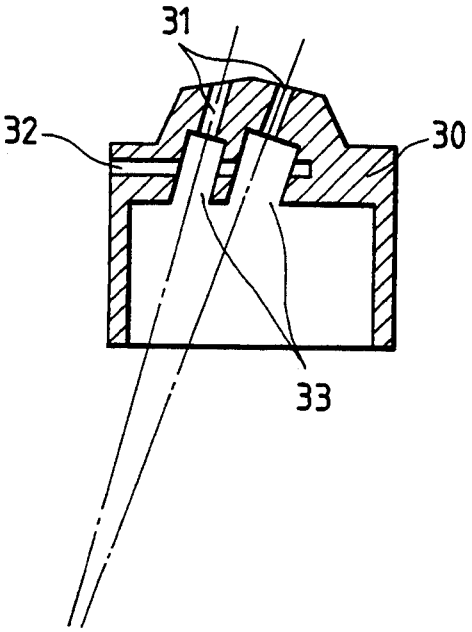
FIG. 29(*a*) is a cross section of a major part of the twenty first embodiment of fuel injection valves according to the present invention and FIG. 29(*b*) is the bottom view thereof.
Figure 29B:
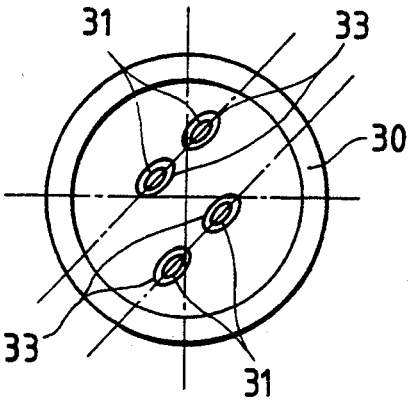

FIG. 29(*a*) is a cross section of a nozzle body in the fuel injection valve of the twenty first embodiment according to the present invention and FIG. 29(*b*) is the bottom view of the nozzle body shown in FIG. 29(*a*).

In the present embodiment, a nozzle body 30 is provided with a plurality of pairs of fuel nozzles 31 and the angles of the paired fuel nozzles 31 are selected in such a manner that the fuel injected from the respective paired fuel nozzles 31 collides with each other. Further, respective orifices constituting air swirling chambers are disposed adjacent to the respective corresponding fuel nozzles 31.

Air nozzles 32 with respective air passages introducing air from the outside are arranged essentially with regard to the respective air swirling chambers 33; for example, the respective axis lines of the air nozzles extend on tangential lines of the circumference of the air swirling chambers, so that the air introduced into the air swirling chambers 33 is adapted to form a swirling flow.

According to the present embodiment, like the twentieth embodiment, the fuel injected from the respective fuel nozzles 31 is provided with a swirling force in the respective air swirling chamber immediately after the injection, is accelerated and is thin-film. Thereafter, the fuel injected from the paired fuel nozzles 31 is caused to collide with each other to further enhance the thin filming and a part of the fuel is atomized. Thereafter, fuel in the form of thin films mixes with the swirling air to atomize the same.

Figure 30:
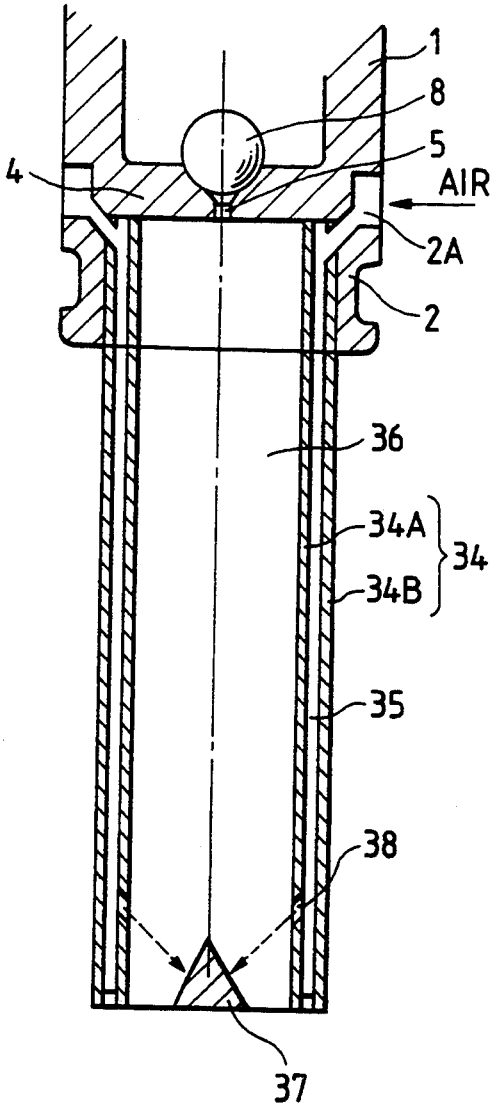
FIG. 30 is a cross section of a major part of the twenty second embodiment of fuel injection valves according to the present invention.

FIG. 30 is a cross section of a major part a twenty second embodiment according to the present invention.

In the present embodiment, a fuel nozzle 5 is disposed at the lower portion of the fuel injection valve and a cylindrical member 34 of a double wall structure consisting of covers 34A and 34B is provided downstream the fuel nozzle 5. The inside portion of the inner cover 34A of the cylindrical member 34 serves as a passage for the injected fuel and at the outlet portion of the injected fuel passage 36 a artition 37 is provided which divides the passage into a plurality of branched passages, in the present embodiment two branched passages, and causes the fuel passing therethrough to collide. The cross section of the partition 37 is selected to be a rectangular shape.

The annular space formed between the inner cover 34A and the outer cover 34B constitutes an air passage 35, the inlet side of the air passage 35 communicates with an air introducing passage 2A provided in a nozzle body 2 and the inner cover 34A is provided with air nozzles 38 at the positions near the partition 37. The cylindrical member 34 is formed to extend through an engine intake tube toward the respective intake valves.

With the present embodiment, the fuel injected from the fuel nozzle 5 passes through the inner passage 36 in the cylindrical member 34 and a great part of the fuel passing therethrough is caused to collide with the sloping surfaces of the partition 37 when the fuel is injected from the outlet of the cylindrical member 34, a part of the fuel is atomized and injected therefrom and the fuel remaining on the surfaces of the partition 37 forms thin films thereon. Further, air introduced through the air passage 34 is injected from the air nozzles 38 toward the partition 37 and blows out the thin filmed fuel on the partition surfaces to atomize the same. With this constitution, the atomized fuel is fed near to the respective intake valves of the internal combustion engine, the fuel composition on the wall of intake tube is eliminated.

We claim:

1. A fuel injection valve comprising, a cylindrical nozzle body having a raised bottom portion constituting a lower part of the fuel injection valve, the raised bottom portion being provided with a metering orifice serving as a fuel nozzle;

a fuel swirler located upstream of said metering orifice for applying to the fuel a swirling force, said fuel swirler being disposed inside said cylindrical nozzle body above the raised bottom portion; and an air swirler including an air swirling chamber and an air nozzle disposed inside said cylindrical nozzle body below the raised bottom portion for introducing air into said air swirling chamber and causing a swirling air flow therein directed opposite to the swirling fuel flow, whereby the swirling fuel flow immediately after being injected from said fuel nozzle is caused to collide with the swirling air flow in said air swirling chamber.

2. A fuel injection valve according to claim 1, wherein an outlet port of said air swirling chamber is expanded in a taper shape.

3. A fuel injection valve according to claim 1, wherein an outlet port of said air swirling chamber is restricted in a taper shape.

4. A fuel injection valve comprising, a cylindrical nozzle body having a raised bottom portion constituting a lower part of the fuel injection valve, the raised bottom portion being provided with a metering orifice serving as a fuel nozzle;

a fuel swirler located upstream of said metering orifice for applying to the fuel a swirling force, said fuel swirler being disposed inside said cylindrical nozzle body above the raised bottom portion;

an air swirler including an air swirling chamber and an air nozzle disposed inside said cylindrical nozzle body below the raised bottom portion for introducing air into said air swirling chamber and causing a swirling air flow therein directed opposite to the swirling fuel flow, whereby the swirling fuel flow immediately after being injected from said fuel nozzle is caused to collide with the swirling air flow in said air swirling chamber;

a cover which is secured to the lower part of the fuel injection valve to cover the same, said cover being positioned to sandwich said air swirler with said cylindrical nozzle body; and an air passage communicating with said air nozzle in said air swirler formed between said cover and said cylindrical nozzle body.

5. A fuel injection valve according to claim 4, wherein an outlet port of said air swirling chamber is expanded in a taper shape.

6. A fuel injection valve according to claim 4, wherein an outlet port of said air swirling chamber is restricted in a taper shape.

7. A fuel injection valve comprising, a fuel nozzle;

means for injecting fuel via said fuel nozzle while swirling the same;

a mixing chamber for mixing the injected fuel and air disposed downstream said fuel nozzle adjacent to an outlet port thereof; and a plurality of pairs of air nozzles disposed so as to face said mixing chamber, respective ones of said paired air nozzles being arranged on opposite sides of the axis of said fuel nozzle so as to locate said fuel nozzle therebetween, and the axes of said paired air nozzles being disposed in such a manner that the air injected from respective ones of the paired air nozzles is directed substantially toward the center of said mixing chamber and respective air streams from said paired air nozzles are slightly offset from each other in a direction opposed to the swirling fuel.

8. A fuel injection valve comprising, a fuel nozzle;

means for swirling fuel and for injecting the swirled fuel via said fuel nozzle;

fuel branching nozzles disposed downstream of said fuel nozzle for branching the injected fuel into a plurality of streams;

an air swirling chamber disposed downstream of said fuel branching nozzles, said air swirling chamber being divided into respective air swirling chambers for receiving the respective streams from said fuel branching nozzles;

an air nozzle which introduces air into said air swirling chamber and causes a swirling air flow therein disposed adjacent to outlet ports of said fuel branching nozzles; and orifices disposed downstream of said respective divided air swirling chambers for directing the injected fuel toward an intake tube.

9. A fuel injection valve comprising, a fuel nozzle;

means for injecting fuel via said fuel nozzle while swirling the same;

fuel branching nozzles disposed downstream of said fuel nozzle for branching the injected fuel into a plurality of parts;

an air swirling chamber disposed downstream of said fuel branching nozzles;

an air nozzle which introduces air into said air swirling chamber and causes a swirling air flow therein disposed adjacent to outlet ports of said fuel branching nozzles; and a partition member having a triangular cross section in the direction of the fuel stream disposed immediately below said fuel branching nozzles for dividing said air swirling chamber and causing the fuel passing through said air swirling chamber to collide with the sloping surfaces of said partition member.

10. A fuel injection valve comprising, a fuel nozzle;

means for injecting fuel via said fuel nozzle while swirling the same;

a separate fuel branching member disposed immediately below said fuel nozzle and including branched passages forming an hour glass shaped aperture for branching the fuel immediately after being injected from said fuel nozzle into a plurality of parts;

an air mixing chamber disposed downstream of said fuel branching members; and an air nozzle which introduces air into said air mixing chamber and causes an air flow to collide with the swirling fuel therein disposed adjacent to said fuel branching member, said air mixing chamber being divided into a plurality of parts corresponding to the branched passages provided in said fuel branching member.

11. A fuel injection valve comprising;

a fuel nozzle;

a plurality of pairs of branching fuel nozzles disposed downstream said fuel nozzle for injecting fuel streams, the axes of said paired branching nozzles being directed in such a manner that the fuel streams injected from said paired branching fuel nozzles collide with each other;

an air swirling chamber disposed downstream of said plurality of pairs of branching fuel nozzles; and an air nozzle which introduces air into said air swirling chamber and causes a swirling air flow therein disposed adjacent to outlet ports of said branching fuel nozzles.

* * * * *